US010937394B2

(12) United States Patent
Blain et al.

(10) Patent No.: US 10,937,394 B2
(45) Date of Patent: Mar. 2, 2021

(54) ORGAN WITH VARIABLE KEY TENSION

(71) Applicant: CASAVANT FRÈRES, Saint-Hyacinthe (CA)

(72) Inventors: Denis Blain, Saint-Liboire (CA); Jens Peter Petersen, Laval (CA)

(73) Assignee: CASAVANT FRÈRES, Saint-Hyacinthe (CA)

( * ) Notice: Subject to any disclaimer, the term of this patent is extended or adjusted under 35 U.S.C. 154(b) by 0 days.

(21) Appl. No.: 16/625,409

(22) PCT Filed: Jun. 18, 2018

(86) PCT No.: PCT/CA2018/050735

§ 371 (c)(1),
(2) Date: Dec. 20, 2019

(87) PCT Pub. No.: WO2019/000078

PCT Pub. Date: Jan. 3, 2019

(65) Prior Publication Data

US 2020/0388250 A1 Dec. 10, 2020

Related U.S. Application Data

(60) Provisional application No. 62/527,456, filed on Jun. 30, 2017.

(51) Int. Cl.

| | |
|---|---|
| ***G10D 3/10*** | (2006.01) |
| ***G10B 3/10*** | (2006.01) |
| ***G10B 1/06*** | (2006.01) |

(52) U.S. Cl.
CPC *G10B 3/10* (2013.01); *G10B 1/06* (2013.01)

(58) Field of Classification Search
CPC ..... G10L 33/10; G10L 1/06
See application file for complete search history.

(56) References Cited

U.S. PATENT DOCUMENTS 10,580 A * 2/1854 Sumner ..... G10B 1/00 84/450
326,624 A * 9/1885 Carpenter et al. ..... G10B 3/10 84/369

(Continued)

FOREIGN PATENT DOCUMENTS

DE 19856019 6/2000
EP 0459129 12/1991

(Continued)

OTHER PUBLICATIONS

English Abstract—Machine Translation of EP0459129A2, "Mechanical return aid assembly for the actions of a mechanical keyboard instrument, in particular for organs, with an arrangement for activating or deactivating this assembly", published on Dec. 4, 1991.

(Continued)

*Primary Examiner* — Robert W Horn
(74) *Attorney, Agent, or Firm* — Bereskin & Parr LLP/S.E.N.C.R.L., s.r.l.

(57) ABSTRACT

An organ includes keys, a windchest in fluid flow communication with a wind supply. A windchest pallet disposed inside the windchest and connected to the key. An auxiliary chamber is independent from the windchest and in fluid flow communication with a wind regulator. An auxiliary pallet is disposed inside the auxiliary chamber and connected to the key. A first adjustment element controls wind generated from the wind regulator. A bias element urges the auxiliary pallet in a closed position. A second adjustment element controls tension exerted by the bias element on the auxiliary pallet.

22 Claims, 3 Drawing Sheets

(56) References Cited

U.S. PATENT DOCUMENTS

| | | | | |
|---|---|---|---|---|
| 465,208 | A | 12/1891 | Sanborn | |
| 582,918 | A | 5/1897 | Hobbs | |
| 769,889 | A | 9/1904 | Davis | |
| 853,949 | A | 5/1907 | Binnig | |
| 896,452 | A | 8/1908 | Kent | |
| 1,699,363 | A | 1/1929 | Klann | |
| 1,760,813 | A * | 5/1930 | Casavant | G10B 3/10 84/345 |
| 1,821,285 | A | 9/1931 | Barrows | |
| 1,821,286 | A | 9/1931 | Barrows | |
| 3,094,890 | A | 6/1963 | Schoenstein | |
| 3,722,347 | A | 3/1973 | Schlicker | |
| 3,795,170 | A | 3/1974 | Klann | |
| 7,626,104 | B2 | 12/2009 | Scriba et al. | |

FOREIGN PATENT DOCUMENTS

| | | |
|---|---|---|
| GB | 338593 | 11/1930 |
| GB | 382907 | 11/1932 |
| GB | 605096 | 7/1948 |

OTHER PUBLICATIONS

English Translation—Machine Translation of DE19856019A1, "Dynamic organ with key and valve control uses first and second springs to control keying force from easy to heavy in second part of path providing sudden increase in volume", Published on Jun. 8, 2000.

Thesis for the Degree of Licenciate of Engineering of Erkin Asutay, "Physical measurements and subjective characterization of pipe organ mechanical key actions", Department of Civil and Environmental Engineering, Division of Applied Acoustics, Chalmers University of Technology, Gothenburg, Sweden, 2013.

* cited by examiner

ORGAN WITH VARIABLE KEY TENSION

CROSS-REFERENCE TO RELATED APPLICATIONS

The present application is a 35 USC 371 national stage entry of PCT/CA2018/050735 filed on Jun. 18, 2018 and which claims priority on U.S. 62/527,456 filed on Jun. 30, 2017. These documents are which is hereby incorporated by reference in their entirety.

FIELD OF THE DISCLOSURE

The present disclosure relates to an organ. In particular, the present disclosure relates to an organ with a variable key tension.

BACKGROUND OF THE DISCLOSURE

The pipe organ is a musical instrument that varies greatly in size and capacity. The concert hall organ can easily be as large as 40'×40'×20' deep. The small practice organ can on the other hand be as small as 6' wide×8' tall×5' deep. On mechanical action organs, the tension on the keyboards will also vary a lot depending of the size of the instrument, its building quality, its level of technology as well as its age. The organist, whether a professional or a student that wants to practice a piece of music in order to master the interpretation will have access to an instrument that usually is much smaller than a concert hall or church organ.

As small practice instruments are usually much smaller than large church or concert hall instruments their keyboard tension will be much lighter than a large instrument. Thus not being the ideal set-up to rehearse a piece that will be much more demanding when played on such larger instrument.

SUMMARY OF THE DISCLOSURE

It would thus be highly desirable to be provided with an apparatus or method that would at least partially solve one of the problems mentioned or that would be an alternative to the existing technologies According to one aspect, there is provided an organ comprising a key; a windchest in fluid flow communication with a wind supply; a windchest pallet disposed inside the windchest and connected to the key; an auxiliary chamber independent from the windchest and in fluid flow communication with a wind regulator; an auxiliary pallet disposed inside the auxiliary chamber and connected to the key; a first adjustment element for controlling wind generated from the wind regulator; a bias element for urging the auxiliary pallet in a closed position; and a second adjustment element for controlling tension exerted by the bias element on the auxiliary pallet.

According to another aspect, there is provided a device for controlling a tension of a key of an organ, comprising: an auxiliary chamber adapted to be independent from a windchest of the organ, the auxiliary chamber being configured to be in fluid flow communication with a wind regulator; an auxiliary pallet disposed inside the auxiliary chamber and connected to the key; a first adjustment element for controlling wind generated from the wind regulator; a bias element for urging the auxiliary pallet in a closed position; and a second adjustment element for controlling tension exerted by the bias element on the auxiliary pallet.

According to one aspect, there is provided a method for controlling key tension of keys of an organ, comprising: controlling air pressure exerted on an auxiliary pallet of an auxiliary chamber that is independent from the windchest, the auxiliary pallet being connected to said key; and controlling tension exerted on a bias element that urges the auxiliary pallet in a closed position, the bias element being connected to the key.

According to another aspect, there is provided a method of controlling key tension of a key of an organ, comprising: connecting an auxiliary pallet to the key, the auxiliary pallet disposable inside an auxiliary chamber, the auxiliary chamber being independent of a windchest of the organ; controlling wind generated inside the auxiliary chamber; and controlling tension exerted by a bias element on the auxiliary pallet.

BRIEF DESCRIPTION OF THE DRAWINGS

The following drawings represent examples that are presented in a non-limitative manner.

DETAILED DESCRIPTION OF THE DISCLOSURE

Figure 1A:
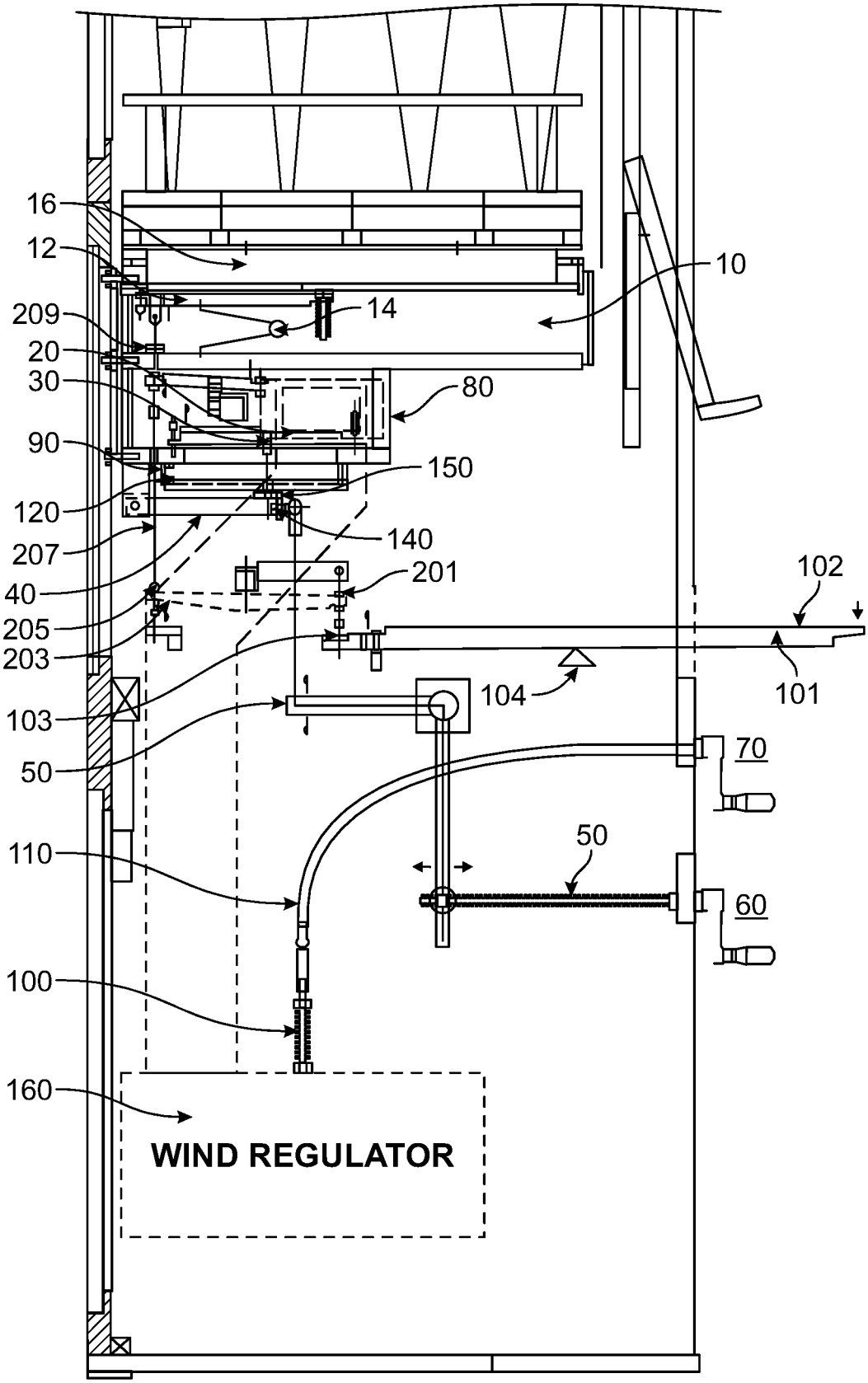
FIG. 1A illustrates a schematic cross section view of an organ according to one example.

The following examples are presented in a non-limitative manner.

For example, the organ can include an auxiliary pallet that is connected to the windchest pallet for providing tension to a key when the key is pressed.

For example, the organ can further include an exhaust chamber adjacent to the auxiliary chamber, wherein the exhaust chamber is kept separated from the auxiliary chamber by the auxiliary pallet when the auxiliary pallet is at the closed position.

For example, the exhaust chamber can comprise an exhaust control gate.

For example, the exhaust control gate can define an aperture.

For example, the size of the aperture can be is variable.

For example, an air pressure of the auxiliary chamber can be controlled by the wind regulator.

For example, the air pressure can be 0 to 250 mm or about 10 to about 225 Water Column.

For example, in the device, the auxiliary pallet is connected to a windchest pallet of the organ for providing tension to the key when the key is pressed.

For example, the device includes an exhaust chamber adjacent to the chamber, wherein the exhaust chamber is kept separated from the chamber by the auxiliary pallet when the auxiliary pallet is at the closed position.

For example, the exhaust chamber comprises an exhaust control gate.

For example, the exhaust control gate defines an aperture.

For example, a size of the aperture is variable.

For example, the air pressure of the auxiliary chamber is controlled by the wind regulator.

For example, the air pressure is 0 to 250 mm or about 10 to about 225 mm Water Column.

The forces that an organist has to handle while playing come mainly from two different elements.

One force is the actual sum of the friction and spring tensions encountered in all the paths of the mechanical elements that connect the keys of the keyboard to the pallets located in the windchest (the box that contains the air under pressure that will be fed to the pipes). Short and simpler mechanics will require less return spring tension and less friction in all the pivots and squares. We call this the spring resistance.

The other force is the resistance of the pallet blocking the air from flowing into the pipes. The larger the instrument, the larger the pressure is, the larger the pallets are, and thus, the higher the force on the key will be needed to overcome the pallet opening or "the suction of the pallets" caused by the pressure differential and the pallet size. The pressure differential is the difference of pressure between the chambers that are above and below the pallet.

In time, here are the events that the organist will feel: As the organist depresses the key, the tension on the pallet increases, thus, the tension on the key increases. When all the tensions from the different elements in the key path are overcome, there is still the pressure differential between the pressure in the pallet box and the key channel to overcome. These 1-2 mm of travel of the pallet will be felt as an increasing tension on the key. Organists usually call this force the "pluck resistance".

When the player pushes a bit further on the key, all of a sudden, the pallet starts to open and as the air flows in the key channel above the pallet, the pressures below and above the pallet equalize leaving almost only the spring resistance on the key. The remaining resistance on the key will be in between 40 to 60% of the maximum resistance. That drop in the key tension when all the forces are suddenly overcome is called the "PLUCK".

Mechanisms can be designed to mimick these two forces. For example, to do so, a small organ can be used with a very light action, to which can be added two additional mechanisms that replicate the characteristics of a larger instrument.

For example, a two manual (2 keyboard) instrument with a windchest is constructed, to which is added an auxiliary pallet for each of the 61 notes located in the auxiliary pallet chamber. A cross section view of a windchest 10 and an auxiliary pallet chamber 80 is shown in FIG. 1A.

With these pallets, it can be possible to modify two main parameters that affect the key tension on the keyboard: the spring tension and the amount of pallet suction or "pluck".

The spring tension can come from several sources:

The mass of the key action.

The amount of directional changes in the path of the key action.

Different sources of friction from like the wear of the key action.

The many axle point for the roller board.

The squares or different pivot points in path of the key action.

To act on this parameter and mimic the variation of the spring tension, a spring 30 is attached at one end on each of the auxiliary pallets. The other ends of the springs are attached to a member that can be moved away from the pallet. For example, a spring can be attached to a lever 40 and can be moved by mean of the lever 40 and the square with its mechanism 50.

The lever 40 has its pivots attached to the bottom of the windchest at one end. The square 50 end is pull or pushed by threaded rod connected to a crank 60 that the player have access to. As the player turns the crank clockwise, the bar moves further down thus increasing the tension of the springs attached to the auxiliary pallet. This system can then vary the spring tension of the key action.

The other parameter is the amount of pallet suction or "pluck". This phenomenon is caused by an initial pallet resistance that drops when the pallet is opened. The resistance drops as the pressures above and below the pallet are almost equalized. This force that a player needs to overcome is a result of pressure acting against the opening of the pallet.

The tension at the opening is the product of the area of the pallet opening multiplied by the wind pressure that has been set in the windchest 10. The auxiliary pallet which is located above an opening in the auxiliary pallet chamber 80 is used to add some "pluck" and will have its additional tension controlled by the pressure it is submitted to.

Varying the pressure in the auxiliary pallet chamber will make the additional "pluck" to vary accordingly. To vary the pressure, a second wind regulator 160 is added in the organ. Its setting can be adjusted by the use of the second crank which acts on the regulator spring 100 by the mean of flexible shaft 110. The pressure can then be varied from 0 to 250 mm Water Column. Higher tension can be achieved using a higher blower pressure when available.

For each of the notes, another device can be located at the back of the bottom of the auxiliary pallet chamber modifies the "after touch" effect when the original "pluck" is overcome. This other device creates a restriction in the air exhaust 120 which lessens or accentuates the peak-fall resistance of the first millimetres of the pallet travel. This device is factory adjusted.

When both tension mechanisms are set to their minimums, there is no tension added to the actual key action of the organ. The organist can them play the organ with the actual tension characteristics of a regular instrument of that size. And since the auxiliary pallet chamber pressure and tension are independent of the windchest, varying the pressure in the auxiliary pallet chamber as absolutely no effect on the speech of the pipe-work.

According to one example, there is disclosed an organ mechanism that allows the variation of the key tension. As shown in FIG. 1A, there is disclosed a cross section view of an organ.

A key 101 of the organ has a tip 102. When pressing on the key, a user presses on the tip 102 of the key 101. The key is balanced at a portion of the key. For example, the key 101 pivots at point 104.

The end portion of the key is connected to a lever. For example, a link connects the end 103 of the key to one end 201 of the lever 203. The fulcrum of the lever is fixed.

The other end of the lever 205 is connected to the windchest pallet. The lever can be connected to the windchest pallet by a link. The link can be a wire, a sticker, a rod, a tracker.

When a user presses at the tip 102 of the key 101:

the tip 102 moves down as the key 101 pivots on pivot 104;

the end 103 of the key 101 moves up;

the lever end 201 moves up;

the lever 203 pivots and the lever end 205 moves down and pulls down link 207, which pulls down the windchest pallet 12 to an opened position.

By moving down, the lever end 205 exerts a downward force on the windchest pallet 12. For example, this downward force can open the pallet 12.

A key can have a certain amount of weight to it, so the finger of the organist can exert more of less energy to make it move. The force that is needed to pull down the windchest pallet can provide a resistance that is felt at the key. This resistance gives the user a certain amount of feedback. This feedback can have a nice "feel" to it. The key can require moderate downward pressure and still have a very nice "feel". The resistance can be just enough that the organist is aware it is there.

The windchest pallet 12 is maintained in closed position by the tension exerted on it by spring 14. The windchest pallet 12 is also maintained in closed position by the air pressure inside the windchest. In a closed position, the windchest pallet 12 blocks the air from flowing into the pipes. As such, there is a difference of pressure on both sides of the pallet. The air pressure in the windchest under the pallet is different from the air pressure of the key channel on top of the pallet. The pressure differential acting on the pallet causes the pallet to be sucked in the closed position. This force acting on the windchest pallet is called the "pluck resistance".

Referring to FIG. 1A, the windchest 10 is in fluid flow communication with a wind supply. The windchest is the box that contains the air under pressure that will be fed to the pipes.

A windchest pallet 12 is disposed inside the windchest 10 and connected to the key 101. The pallet 12, at a closed position, keeps the windchest and the key channel separated. The windchest 10 contains pressurized air, and the key channel 16 is connected to the pipes. The windchest pallet covers a groove that allows air to flow to the pipes when the pallet is at an opened position.

All the pipes for one particular key sit on an opening to the key channel, so that when the pallet opens, pressurized air is admitted to the pipes via the groove in the key channel. The pallet can be kept closed by a spring when the key is not pressed.

For example, a spring is connected to the windchest pallet, keeping it in a closed position. The spring can be a V-shaped spring.

Figure 1B:
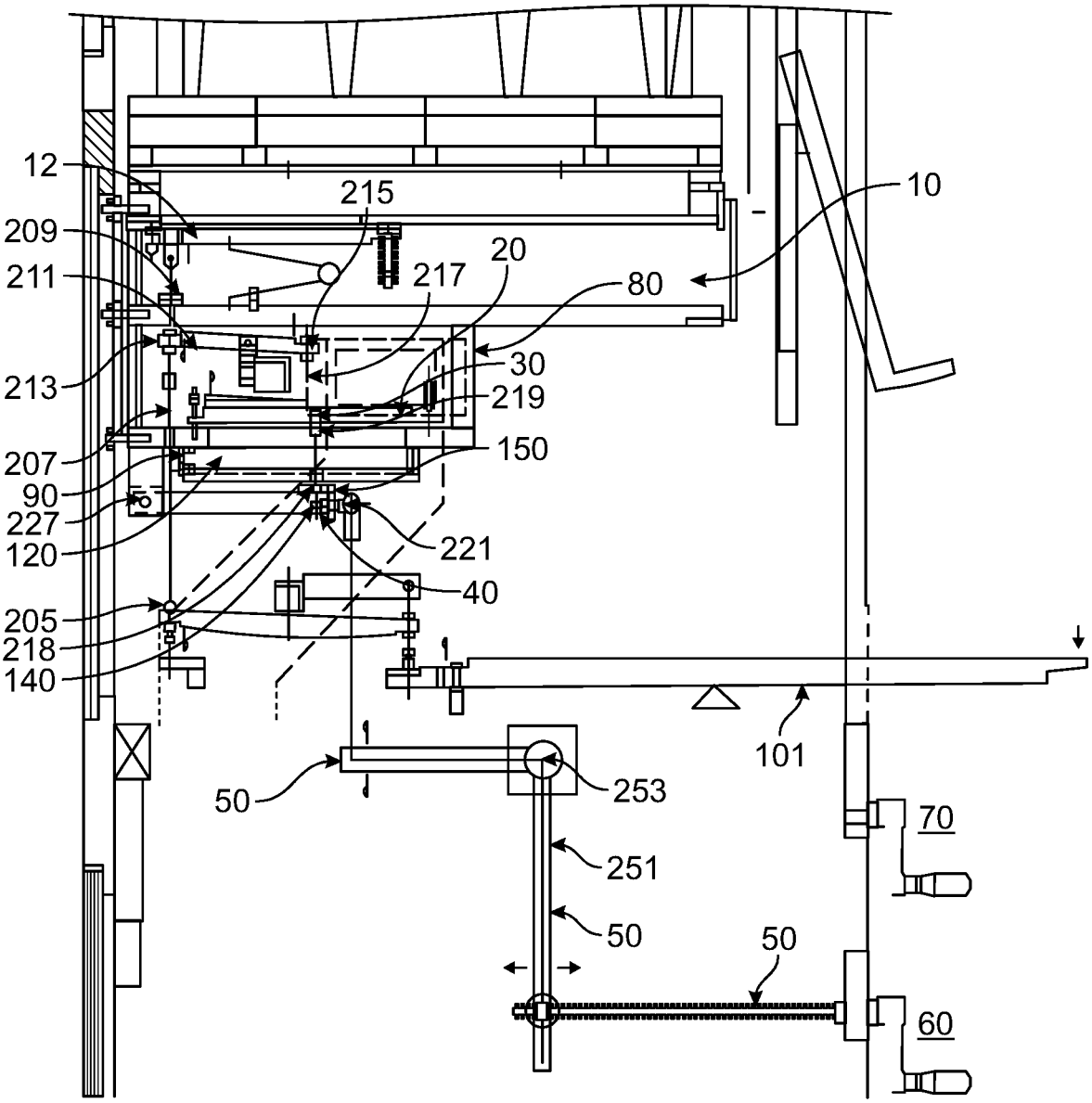
FIG. 1B illustrates a schematic cross section view of an organ according to another example.
Figure 1C:
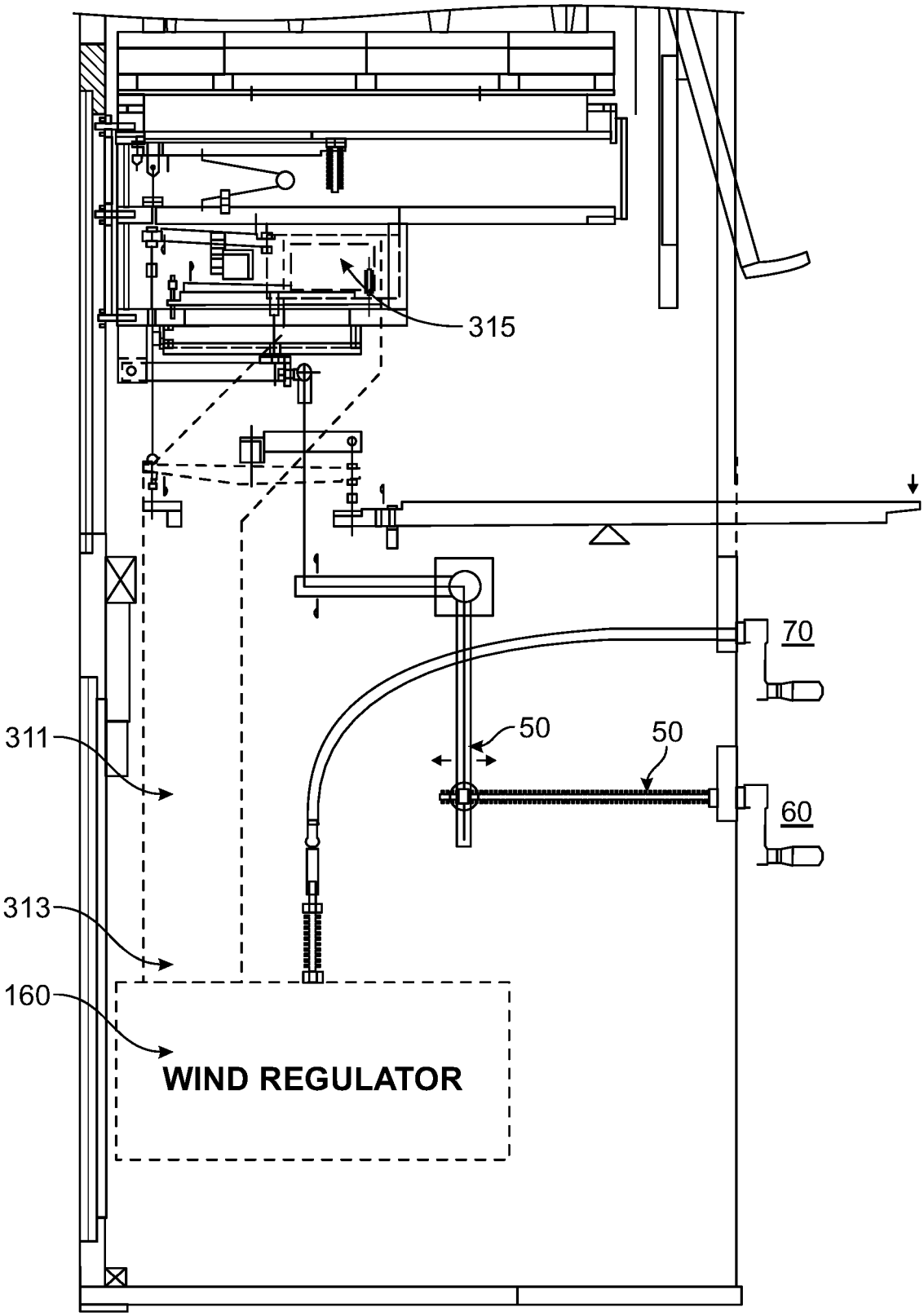
FIG. 1C illustrates a schematic cross section view of an organ according to another example.

Referring to FIG. 1B, an auxiliary chamber 80 is located under the windchest 10. The auxiliary chamber is independent from the windchest.

The auxiliary chamber 80 is in fluid flow communication with a wind regulator 160. As shown in FIG. 10, a conduit 311 provides a connection between the auxiliary chamber 80 and the wind regulator 160. One end 313 of the conduit 311 is connected to the wind regulator 160. The other end 315 of the conduit 311 is connected to an opening of the auxiliary chamber 80. The conduit 311 is configured to pass a fluid, such as air, from the wind regulator to the auxiliary chamber 80.

Referring back to FIG. 1B, a lever 211 is disposed in the auxiliary chamber. The lever 211 has two ends: end 213 and end 215. The lever end 213 is connected to the link 207.

An auxiliary pallet 20 is disposed in the auxiliary chamber 80. The auxiliary pallet 20 is connected to the key 102 through a lever 211, which is connected to the link 207. The lever end 215 is connected to the auxiliary pallet 20 by way of link 217. The auxiliary pallet 20, at its rest position, keeps the auxiliary pallet chamber 80 separated from the exhaust chamber 120.

In one example, the link 207 passes through the auxiliary pallet chamber 80. Insulation gaskets can be used at the point of entry of the link into the auxiliary chamber to prevent pressure leakage inside the auxiliary chamber. For example, insulation gasket 209 prevents any air pressure leakage between the auxiliary pallet chamber 80 and the windchest 10.

Referring to FIG. 1B, the link 207 is connected to a lever 211 inside the auxiliary pallet chamber 80, such that one end 213 of the lever 211 is connected to the link 207.

The auxiliary pallet 20 is connected to the windchest pallet 12 for providing tension to the key 101 when the key is pressed. When a user presses on the key 101, as the lever end 205 moves down and pulls down the link 207 to open the windchest pallet 12 disposed in the windchest, the following happens inside the auxiliary pallet chamber 80:

- the end 213 of the lever 211 is pulled down
- the lever 211 pivots and the end 215 of the lever 211 moves up
- by moving up, the lever end 215 exerts an upward force on the link 217 to pull up the auxiliary pallet 20.

For example, this upward force on link 217 can open the auxiliary pallet 20. Varying the pressure in the auxiliary pallet chamber will make the additional "pluck" to vary accordingly. The pressure in the auxiliary pallet chamber 80 can be varied by a wind regulator 160. The pressure in the auxiliary pallet chamber 80 can also be varied by the structure of the exhaust chamber 120 and the exhaust control gate 90.

The force that is needed to activate the windchest pallet and/or the auxiliary pallet can provide a resistance that is felt at the key. This resistance gives the organist a certain amount of feedback at the key that has particular tension, sensation, or "feel" to it. The tension, sensation, or "feel" is also felt at the key when the windchest pallet and/or the auxiliary pallet are in an opened position.

The organist can be able to set the tension, sensation, or "feel" at the key by adjusting the resistance exerted by a bias element on the auxiliary pallet.

The organist can be able to set the tension, sensation, or "feel" at the key by adjusting the air pressure in the auxiliary chamber or by controlling wind generated in the auxiliary chamber by a wind regulator.

The organist can be able to set the tension, sensation, or "feel" at the key by adjusting the air pressure in the auxiliary chamber or by adjusting the exhaust chamber and exhaust control gate.

A first adjustment element 70 is used to control wind generated from the wind regulator. For example, the wind regulator 160 is used to vary the pressure inside the auxiliary pallet chamber 80. In one example, the first adjustment element can be a crank. For example, the setting of the wind regulator can be adjusted by the use of the crank. The crank acts on the regulator spring 100 by the mean of flexible shaft 110. There is a blower that feeds both the "standard" wind regulator that feeds the windchest (not shown) and the adjustable wind regulator 120 by varying the tension of the spring 100 which opposes itself to the incoming pressure from the blower. The pressure can then be varied in the auxilliary pallet chamber from 0 to 250 mm Water Column. Higher tension can be achieved using a higher blower pressure when available.

In one example, there is an exhaust chamber adjacent to the auxiliary chamber. The exhaust chamber is kept separated from the auxiliary chamber by the auxiliary pallet when the auxiliary pallet is at the closed position. The exhaust chamber can have an exhaust control gate 90. The exhaust control gate defines an aperture. The size of the aperture can be variable.

Referring to FIG. 1B, the exhaust chamber 120 is located under the auxiliary pallet chamber 80. The exhaust chamber 120 is kept separated from the auxiliary pallet chamber 80 by the auxiliary pallet 20 at its closed position. The exhaust chamber 120 has an exhaust control gate 90, which defines an aperture. The aperture can be located anywhere on the perimeter of the exhaust chamber. The size of the exhaust control gate 90 can be varied. Changing the size of the exhaust control gate opening 90 varies the amount of air that can leave the exhaust chamber 120 when the auxiliary pallet 20 is in an open position.

As soon as the auxiliary pallet is pulled up to an opened position, the exhaust chamber pressure will increase. The amount of air escaping it is controlled in such a way that once the pallet is opened the pressure differential is reduced thus affecting the suction effect on the auxiliary pallet.

Varying the pressure in the auxiliary pallet box will make the "pluck" to vary accordingly.

The pressure in the auxiliary pallet chamber 80 can be varied by the wind regulator 160.

The pressure flowing out of the auxiliary pallet chamber 80 when the auxiliary pallet is opened can be varied by the structure of the exhaust chamber 120 and the exhaust control gate 90.

The drop or variation of pressure between the auxiliary pallet chamber and the exhaust chamber when the auxiliary pallet is opened will vary depending of the size of the exhaust control gate.

Varying the width of the exhaust control gate 90 modifies the "after touch" effect felt on the key 101 when the original "pluck" is overcome. The exhaust control gate can create a restriction of the air flowing out of the auxiliary pallet chamber as soon as the auxiliary pallet is opened. This restriction lessens or accentuates the peak-fall resistance of the first millimeters of the auxiliary pallet travel. The exhaust control gate can be factory adjusted.

A bias element can be used to urge the auxiliary pallet in a closed position. A second adjustment element can control the tension exerted by the bias element on the auxiliary pallet.

In one example, the bias element is a spring. Referring to FIG. 1B, the spring 30 is connected to the auxiliary pallet 20. For example, the end 219 of the spring 30 is connected to the auxiliary pallet 20. The other end 218 of the spring 30 is attached to a lever 40.

The lever 40 is located under the exhaust chamber 120. The lever 40 is attached to a pivot 227. The pivot 227 allows the lever 40 to move in a direction defined by its axis of rotation.

In one example, there is a collar 140 on the on the lever 40. The collar 140 is configured to clamp or hold the end 218 of the spring 30.

When the end 218 of the spring 30 is held by the collar 140, the bar 40 will drag the spring 30 when the lever 40 moves. As the bar 40 moves, the length of the spring 30 will vary, which means the resistance of the spring 30 will vary.

In one example, the other end of the spring is attached to a bar 150 on the lever 40. As the lever moves up and down, the spring 30 will contract or expand, varying the force exerted by the spring on the auxiliary pallet.

The spring is moved away from the pallet by mean of the lever 40 and the square with its mechanism 50. The square mechanism includes the bar 251 and 253, which are perpendicularly connected. The lever 40 has its pivot attached to the bottom of the windchest at one end. The end 221 of the lever 40 is connected to the square mechanism 50.

Referring to FIG. 1B, an adjustment element, such as crank 60, is connected to the square mechanism 50. The square 50 is pulled or pushed by threaded rod connected to the crank 60 that a player have access to. As the player turns the crank 60 clockwise, the bar 251 moves toward the right, and at the same time moves the bar 253 down, thus exerting a downward force on the spring 30. This increases the tension of the spring 30 attached to the auxiliary pallet.

In one example, a device can be installed in an organ to control to the tension of a key. Such device can include an auxiliary chamber as described above.

For example, the device includes an auxiliary chamber adapted to be independent from a windchest of the organ, the auxiliary chamber being configured to be in fluid flow communication with a wind regulator. The inside chamber of the device can be insulated from the outside, to control the air pressure inside the chamber. The auxiliary chamber can be installed anywhere inside an organ. The auxiliary chamber can be located under the windchest of an organ.

The device includes an auxiliary pallet disposed inside the chamber and connected to the key. The auxiliary pallet can be directly connected to the key. The auxiliary pallet can be connected to a link between the key and a pallet of the windchest of an organ. For example, the auxiliary pallet can be connected to a pallet located in the windchest of the organ for providing tension to the key when the key is pressed.

The device includes a first adjustment element for controlling wind generated from the wind regulator. The air pressure of the auxiliary chamber is controlled by the wind regulator. The air pressure can be between 0 to 250 mm Water Column.

The device includes a bias element for urging the auxiliary pallet in a closed position. The device includes a second adjustment element for controlling tension exerted by the bias element on the auxiliary pallet.

The device includes an exhaust chamber adjacent to the auxiliary chamber, wherein the exhaust chamber is kept separated from the auxiliary chamber by the auxiliary pallet when the auxiliary pallet is at the closed position. The exhaust chamber includes an exhaust control gate. The exhaust control gate defines an aperture. The size of the aperture is variable. A method for controlling key tension of keys of an organ is also disclosed. The method includes controlling air pressure exerted on an auxiliary pallet of an auxiliary chamber that is independent from the windchest, the auxiliary pallet being connected to said key.

The method further includes controlling tension exerted on a bias element that urges the auxiliary pallet in a closed position, the bias element being connected to the key.

The method includes controlling an exhaust control gate to vary the amount of air leaving the exhaust chamber, wherein the exhaust chamber comprises the exhaust control gate the exhaust control gate defining an aperture. The exhaust control gate can be opened or closed. A user can control the opening and closing of the exhaust control gate. A manufacturer can also set the size of the exhaust chamber and the exhaust gate. The method includes controlling the size of the aperture. The size of the aperture can be set by a manufacturer. The size of the aperture can be controlled by a user.

A method of controlling key tension of a key of an organ is also disclosed. The method includes connecting an auxiliary pallet to the key, the auxiliary pallet being disposed inside an auxiliary chamber, the auxiliary chamber being adapted to be independent of a windchest of the organ. For example, the auxiliary pallet can be connected to a link between the key and a pallet located inside the windchest. The method also includes controlling wind generated inside the auxiliary chamber. Further, the method includes controlling tension exerted by a bias element on the auxiliary pallet.

The person skilled in the art would understand that the various properties or features presented in a given example can be added and/or used, when applicable, to any other example covered by the general scope of the present disclosure.

The examples of the paragraphs of the present disclosure are presented in such a manner in the present disclosure so as to demonstrate that every combination of examples, when applicable can be made. These examples have thus been presented in the description in a manner equivalent to making dependent claims for all the examples that depend upon any of the preceding claims (covering the previously presented examples), thereby demonstrating that they can be combined together in all possible manners. For example, all the possible combination, when applicable, between the examples of any paragraphs and the devices and methods of the SUMMARY OF THE DISCLOSURE are hereby covered by the present disclosure.

The present disclosure has been described with regard to specific examples. The description was intended to help the understanding of the disclosure, rather than to limit its scope. It will be apparent to one skilled in the art that various modifications can be made to the disclosure without departing from the scope of the disclosure as described herein, and such modifications are intended to be covered by the present document.

The invention claimed is:

1. An organ comprising a key;

a windchest in fluid flow communication with a wind supply;

a windchest pallet disposed inside the windchest and connected to the key;

an auxiliary chamber independent from the windchest and in fluid flow communication with a wind regulator;

an auxiliary pallet disposed inside the auxiliary chamber and connected to the key;

a first adjustment element for controlling wind generated from the wind regulator;

a bias element for urging the auxiliary pallet in a closed position; and a second adjustment element for controlling tension exerted by the bias element on the auxiliary pallet.

2. The organ of claim 1, wherein the auxiliary pallet is connected to the windchest pallet for providing tension to the key when the key is pressed.

3. The organ of claim 1 or 2, further comprising an exhaust chamber adjacent to the auxiliary chamber, wherein the exhaust chamber is kept separated from the auxiliary chamber by the auxiliary pallet when the auxiliary pallet is at the closed position.

4. The organ of claim 3, wherein the exhaust chamber comprises an exhaust control gate.

5. The organ of claim 4, wherein the exhaust control gate defines an aperture.

6. The organ of claim 5, wherein a size of the aperture is variable.

7. The organ of claim 1, wherein an air pressure of the auxiliary chamber is controlled by the wind regulator.

8. The organ of claim 7, wherein the air pressure is 0 to 250 mm Water Column.

9. A device for controlling a tension of a key of an organ, comprising:

an auxiliary chamber adapted to be independent from a windchest of the organ, the auxiliary chamber being configured to be in fluid flow communication with a wind regulator;

an auxiliary pallet disposed inside the auxiliary chamber and connected to the key;

a first adjustment element for controlling wind generated from the wind regulator;

a bias element for urging the auxiliary pallet in a closed position; and a second adjustment element for controlling tension exerted by the bias element on the auxiliary pallet.

10. The device of claim 9, wherein the auxiliary pallet is adapted to be connected to a windchest pallet of the organ for providing tension to the key when the key is pressed.

11. The device of claim 9, further comprising an exhaust chamber adjacent to the auxiliary chamber, wherein the exhaust chamber is kept separated from the auxiliary chamber by the auxiliary pallet when the auxiliary pallet is at the closed position.

12. The device of claim 11, wherein the exhaust chamber comprises an exhaust control gate.

13. The device of claim 12, wherein the exhaust control gate defines an aperture.

14. The device of claim 13, wherein a size of the aperture is variable.

15. The device of claim 9, wherein an air pressure of the auxiliary chamber is controlled by the wind regulator.

16. The organ of claim 15, wherein the air pressure is 0 to 250 mm Water Column.

17. A method for controlling key tension of keys of an organ, comprising:

controlling air pressure exerted on an auxiliary pallet of an auxiliary chamber that is independent from a windchest, the auxiliary pallet being connected to said key; and controlling tension exerted on a bias element that urges the auxiliary pallet in a closed position, the bias element being connected to the key.

18. The method of claim 17 further comprising:

controlling the amount of air exiting from an exhaust chamber adjacent to the auxiliary chamber, wherein the exhaust chamber is kept separated from the auxiliary chamber by the auxiliary pallet when the auxiliary pallet is at the closed position.

19. The method of claim 18 further comprising:

controlling an exhaust control gate to vary the amount of air exiting from the exhaust chamber, wherein the exhaust chamber comprises the exhaust control gate, the exhaust control gate defining an aperture.

20. The method of claim 19 further comprising:

controlling the size of the aperture.

21. A method of controlling key tension of a key of an organ, comprising:

connecting an auxiliary pallet to the key, the auxiliary pallet being disposed inside an auxiliary chamber, the auxiliary chamber being adapted to be independent of a windchest of the organ;

controlling wind generated inside the auxiliary chamber; and controlling tension exerted by a bias element on the auxiliary pallet.

22. The method of claim 21, wherein connecting the auxiliary pallet to the key comprises connecting the auxiliary pallet to a link between the key and a pallet located inside the windchest.

* * * * *